US006394003B1

(12) United States Patent
Lacy, III

(10) Patent No.: US 6,394,003 B1
(45) Date of Patent: May 28, 2002

(54) PALLET FOOT

(75) Inventor: Curtis R. Lacy, III, Buford, GA (US)

(73) Assignee: Stephen Gould Paper Co., Inc., Whippany, NJ (US)

( * ) Notice: Subject to any disclaimer, the term of this patent is extended or adjusted under 35 U.S.C. 154(b) by 0 days.

(21) Appl. No.: 09/553,236

(22) Filed: Apr. 19, 2000

(51) Int. Cl.[7] ..... B65D 19/00
(52) U.S. Cl. ..... 108/51.3
(58) Field of Search ..... 108/51.3, 56.3, 108/51.11

(56) References Cited

U.S. PATENT DOCUMENTS 3,464,371 A * 9/1969 Gifford ..... 108/51.3
3,626,860 A * 12/1971 Blatt ..... 108/51.3
3,659,534 A * 5/1972 Childs ..... 108/51.3
5,269,219 A * 12/1993 Juvik-Woods ..... 108/56.3 X
5,350,066 A 9/1994 Mendoza et al.
5,370,061 A 12/1994 Kilpatrick et al.
5,483,875 A * 1/1996 Turecek et al. ..... 108/51.3
5,531,165 A 7/1996 Taravella et al.
5,531,166 A * 7/1996 Woods et al. ..... 108/51.3
5,537,935 A * 7/1996 Otaguchi et al. ..... 108/51.3
5,592,885 A * 1/1997 Young, Jr. et al. ..... 105/51.3
5,881,652 A * 3/1999 Besaw ..... 108/51.3
5,996,509 A * 12/1999 Lai ..... 108/51.3

* cited by examiner

*Primary Examiner*—Jose V. Chen
(74) *Attorney, Agent, or Firm*—Kenneth S. Watkins, Jr.

(57) ABSTRACT

A recyclable support apparatus for supporting articles comprises at least two pallet feet attached to the bottom panel of a container. The pallet feet comprise a U-shaped top portion and a U-shaped bottom portion made of a corrugated material. The top portion is inverted with respect to the bottom portion and respective side portions bonded to form a tube of rectangular cross section. At least one stringer is bonded to an inside surface of the through opening to add stacking strength. The pallet feet are bonded to the container bottom so that the through openings are aligned coaxially. Alignment of the through openings allows tines of a fork lift device to be inserted into the through openings of the pallet feet for convenient moving and storage of the container. Pallet foot spacing allows insertion of the tines of a lift fork between the pallet feet, providing four-way lift capability and facilitating container lifting and moving.

15 Claims, 6 Drawing Sheets

PALLET FOOT

BACKGROUND OF THE INVENTION

This invention relates to shipping container support apparatus, and specifically, to recyclable pallets for supporting containers.

Pallets for supporting shipping containers have been know for some time. Pallets serve several useful functions including protection of containers from contaminated floors or other surfaces and facilitating lifting of the containers. One or more containers may be placed on, or attached to, a pallet and moved with a lift device such as a fork lift truck, pallet jack or other device with ease and safety.

Pallets are often made of wood. The weight and bulk of wooden pallets results in high costs for transporting, storing and disposal of the pallets. Another problem is handling and storing pallets after use. Often they must be transported for reuse or refurbishment, further adding to their cost. Often, they are destroyed after use, further adding to already overloaded landfill facilities.

U.S. Pat. No. 5,370,061 discloses a pallet made of corrugated paperboard. Although use of corrugated paperboard is advantageous with respect to weight, bulk and recycling issues, new complications are introduced. The added complexity of corrugated pallets required to provide adequate stiffness and load support strength complicates use with lift apparatus such as fork lift trucks. Also, a large number of different pieces are often required to assemble the pallets, especially if used with different sized containers. Large numbers of parts adds to the cost of inventory and assembly costs of the pallets.

The limitations of present recyclable pallets have demonstrated the need for a simple, low-cost method of supporting containers compatible with automated lift equipment.

OBJECTS AND SUMMARY OF THE INVENTION

Therefore an object of the present invention is to provide a pallet or support assembly for containers which has considerable flexibility for use with different sized containers.

A further object of the present invention is to provide a support assembly for containers which is made of recyclable materials.

A further object of the present invention is to provide a support assembly which reduces the number of different parts, reducing manufacturing and inventory cost.

A further object of the present invention is to provide a support assembly for containers which may be used with lift equipment such as forklift trucks and lift jacks.

A further object of the present invention is to provide a support assembly for containers which may be lifted from any of four sides by lift equipment.

A further object of the present invention is to provide a support assembly for containers which can be easily and quickly attached to the bottom of the container.

A further object of the present invention is to provide a support assembly for containers which reduces the need for different size pallets for different size containers.

Yet another object of the present invention is to provide an integral support assembly for containers which can be assembled from a knockdown configuration without special tools or equipment.

The support assembly of the present invention is a pallet foot made from, at least in part, a recyclable corrugated material such as corrugated paperboard or corrugated plastic. The pallet foot is dimensioned in width so that two or more pallet feet replace a conventional pallet to support a container. The length of the pallet foot is normally equal to, or less than, the length of the container which it is supporting. In the preferred embodiments, the pallet foot is applied to the bottom of a container, such as a corrugated box, by an adhesive.

Dimensioning of the pallet foot so that two or more pallet feet are used to support a container allows greater flexibility, in that the same size pallet foot can be used with a wide variety of container sizes. The pallet foot has spaced through openings allowing lift tines of a standard fork lift or pallet-jack to be inserted. Spacing of the two or more pallet feet allows the tines of a lift fork or lift jack to be inserted between adjacent pallet feet. In this manner, a lift device is able to pick up the container from any of four sides of the container.

In the preferred embodiments, the pallet foot is made of a top pallet foot portion and a bottom pallet foot portion. The top and bottom portions are bonded together at side panels to form an open-ended box structure. Optional stringers add stacking strength and rigidity to the structure. The internal structure of the pallet foot is arranged to allow insertion of the tines of a forklift device into the open ends of the pallet foot.

In the most preferred embodiments, the top portion and the bottom portion are identical folded panels of corrugated material having a U-shaped cross-section. The top portion comprises a top panel and two fold or score lines defining an outside panel and an inside panel. The bottom portion comprises a bottom panel and two fold or score lines defining a second outside panel and a second inside panel. The top portion is inverted and assembled so that the outside panel of the top portion overlaps, and is bonded to, the inside panel of the bottom portion. Likewise, the outside panel of the bottom portion overlaps and is bonded to, the inside panel of the top portion. In this embodiment, the top and bottom portions are manufactured as identical parts, simplifying tooling, dies, inventory and assembly of the pallet feet.

In the preferred embodiments, the ridges and valleys of the top and bottom panel corrugations run along the length direction, and transverse to, the fold lines of the respective top and bottom portions. In this manner, the corrugations of the side panels run vertically, increasing the stacking strength of the pallet foot. The stacking strength is further enhanced by one or more stringers in the rectangular through opening of the pallet foot formed by the top and bottom portions when assembled. The stringers are bonded to the inside surfaces of the top and bottom panels and are placed to allow insertion of standard sized forklift truck tines.

In a preferred embodiment at least two box stringers, extending the width of the pallet foot, are used. The box stringers are made of corrugated material, folded and bonded to form a rectangular open-ended box structure. The length direction of the box stringers, is sufficient for insertion of a standard forklift truck tine, and the height or depth of the box stringer is the same as the inside depth of the pallet foot rectangular opening. The box stringers are bonded to the top panel and the bottom panel. In the preferred embodiments, the box stringers are also bonded to auxiliary stringers or the inside face of the inside panels of the pallet foot to increase stability of the pallet foot. In another preferred embodiment, one or more stringers of laminated or spirally wrapped corrugated material are bonded to the inside surfaces of the top and bottom panels.

Still other embodiments provide pallet feet pre-bonded to the container and supplied in a knockdown configuration. In a preferred embodiment, both the container and attached pallet feet are folded to minimize storage and shipping volume. A user needs only to unfold the container and pallet foot elements and assemble without the need for special tools or materials such as glue guns or banding equipment.

BRIEF DESCRIPTION OF THE DRAWINGS

These and other features, aspects and advantages of the present invention will become better understood with regard to the following description, appended claims and accompanying drawings where:

DESCRIPTION OF THE PREFERRED EMBODIMENTS

The following is a description of the preferred embodiments of a recyclable pallet foot for providing support and lift-device access for a container.

Figure 1:
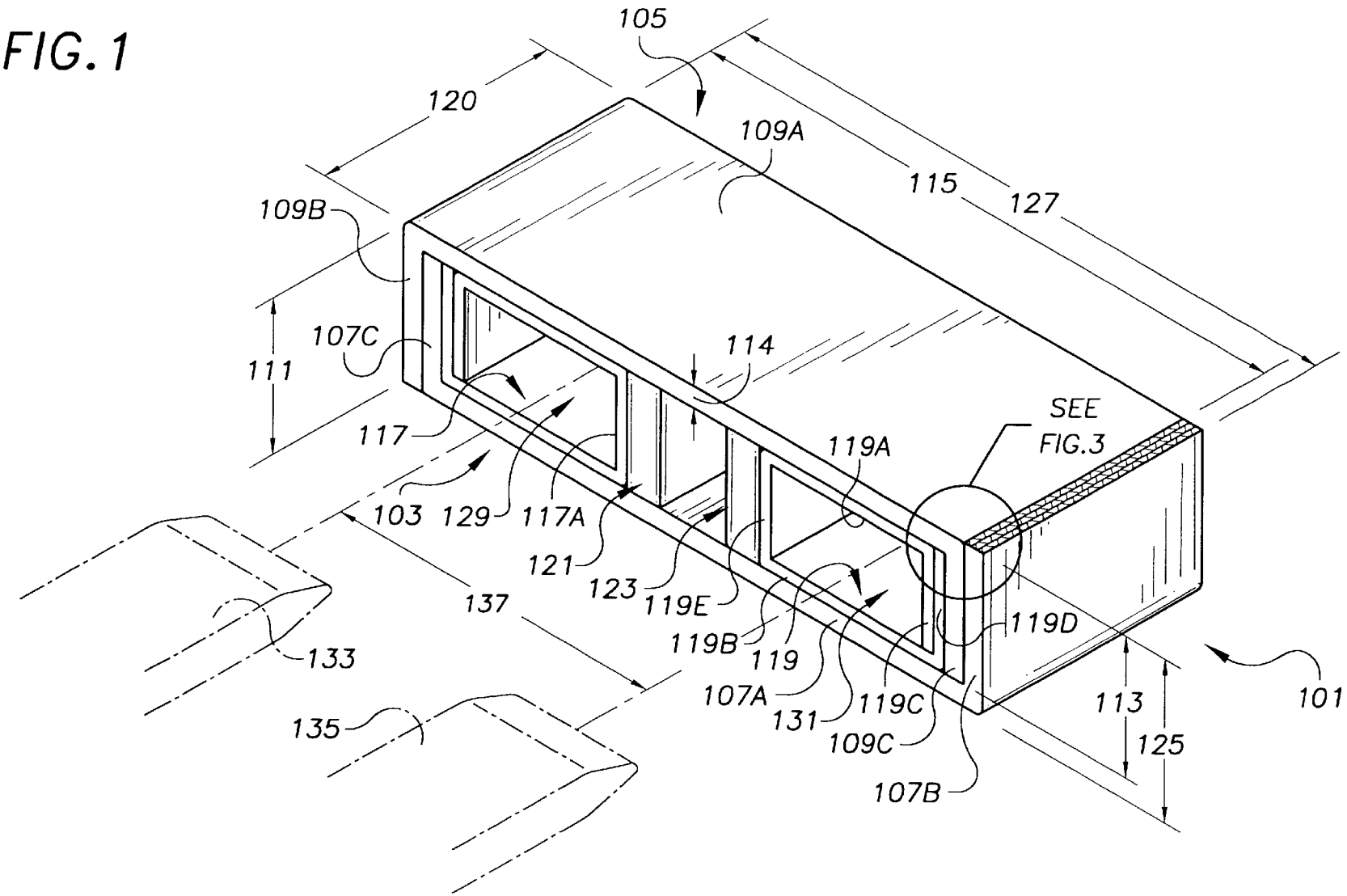
FIG. 1 is a perspective drawing of an embodiment of the pallet foot having identical top and bottom portions with the top portion inverted and assembled to the bottom portion with respective folded inner and outer side panels overlapped and bonded to each other to form an open-ended box structure, and two open-ended fork-receiving box stringers bonded to the inside surfaces of the assembled top and bottom portions, the tines of a fork-type lift device insertable in the through openings of the pallet foot shown in broken lines.

FIG. 1 is a perspective drawing of embodiment 101 of a recyclable pallet foot comprising a bottom portion 103 having a U-shaped cross-section and a top portion 105 having a U-shaped cross section inverted as assembled in the figure. In a preferred embodiment, bottom portion 103 is made of a recyclable corrugated material folded along fold or score lines to form bottom panel 107A, folded outer side panel 107B and folded inner side panel 107C. Top portion 105 is made of a recyclable corrugating material folded to form top panel 109A, folded outer side panel 109B, and folded inner side panel 109C.

In the preferred embodiment, the depth dimension 111 of outer side panel 109B of top portion 105 is the same depth dimension 125 of outer side panel 107B of bottom portion 103. Likewise the depth dimension 113 of inner side panel 109C is the same depth dimension as inner side panel 107C. In the preferred embodiments, depth dimension 111 of the respective outer panels is greater than depth dimension 113 of the respective inner panels by thickness 114, representing the thickness of the top and bottom portions. The length 115 of top panel 109A is the same as the length of bottom panel 107A. Similar dimensions and fold score lines for top portion 105 and bottom portion 103 simplify and reduce cost of tooling, manufacturing, assembly and inventory of the components and assemblies.

Top portion 105 and bottom portion 103 are bonded together at the interfaces of the respective inner side panels 107C and 109C and outer side panels 107B and 109B by an adhesive (not shown). For example, the outer face of inner side panel 109C is bonded to the inner face of outer side panel 107B. First box stringer 117 and second box stringer 119 are rectangular in cross-section, and in the preferred embodiments, extend the full width 120 of pallet foot 101.

Box stringer 119 may be made of corrugating material folded to form stringer top 119A, stringer bottom 119B, inner side sub-panel 119C, outer side sub-panel 119D, and stringer side panel 119E. Sub-panels 119C and 119D are bonded together to form the stringer. Outer side sub-panel 119D of stringer 119 is bonded to inner side panel 109C of top portion 105. Stringer top 119A may also be bonded to top panel 109A, and stringer bottom panel 119B to bottom panel 107A with adhesives to improve the rigidity of the structure. Stringer 117 is made and bonded to pallet foot 101 in a similar manner.

In the preferred embodiments, first box stringer 117 and second box stringer 119 are dimensioned in depth and width to receive standard forklift forks or tines such as lift tines 133 and 135. The added stiffness resulting from the structure and bonding of the box structures to the pallet foot and the padding effect of the box stringers add to the lifting capability of the pallet foot and reduces damage to the pallet foot.

Supplemental stringers 121 and 123 are bonded to the respective box stringer side panels and top panel 109A and bottom panel 107A to further improve rigidity and stacking strength of pallet foot 101. Supplemental stringers 121 and 123 maybe made of laminated or spirally rolled corrugating material and bonded with adhesives.

The top portion 105 and bottom portion 103 of the preferred embodiments are made of a corrugating material such as corrugated containerboard or corrugated plastic. In the most preferred embodiments, the top and bottom portions are made of triple-wall corrugated containerboard having three fluted corrugated medium layers bonded to kraft linerboard plies between the corrugated layers and on the outsides of the panels. The ridges and valleys of the corrugations run in the length 115 directions so that the corrugations in the folded side panels run vertically (in the depth 111 direction) to improve stacking strength. Likewise, the ridges and valleys of the corrugations of the side panels and sub panels of box stringers 117, 119, and supplemental stringers 121 and 123 run vertically to improve stacking strength.

The total length 127 of pallet foot 101 is greater than the length 115 of top panel 109A and bottom panel 107A by the thickness of the corrugated material of respective top and bottom portions.

Placement of stringers such as box stringers 117 and 119 and supplemental stringers 121 and 123 provide lift openings 129 and 131 having width (pallet foot length direction), depth (height) and centerline spacing 137 to allow insertion of standard forklift and pallet jack tines 133 and 135. In the preferred embodiments, lift openings 129 and 131, such as those formed by the inside of box stringers 117 and 119 are open though the fall width 120 of pallet foot 101.

Figure 2:
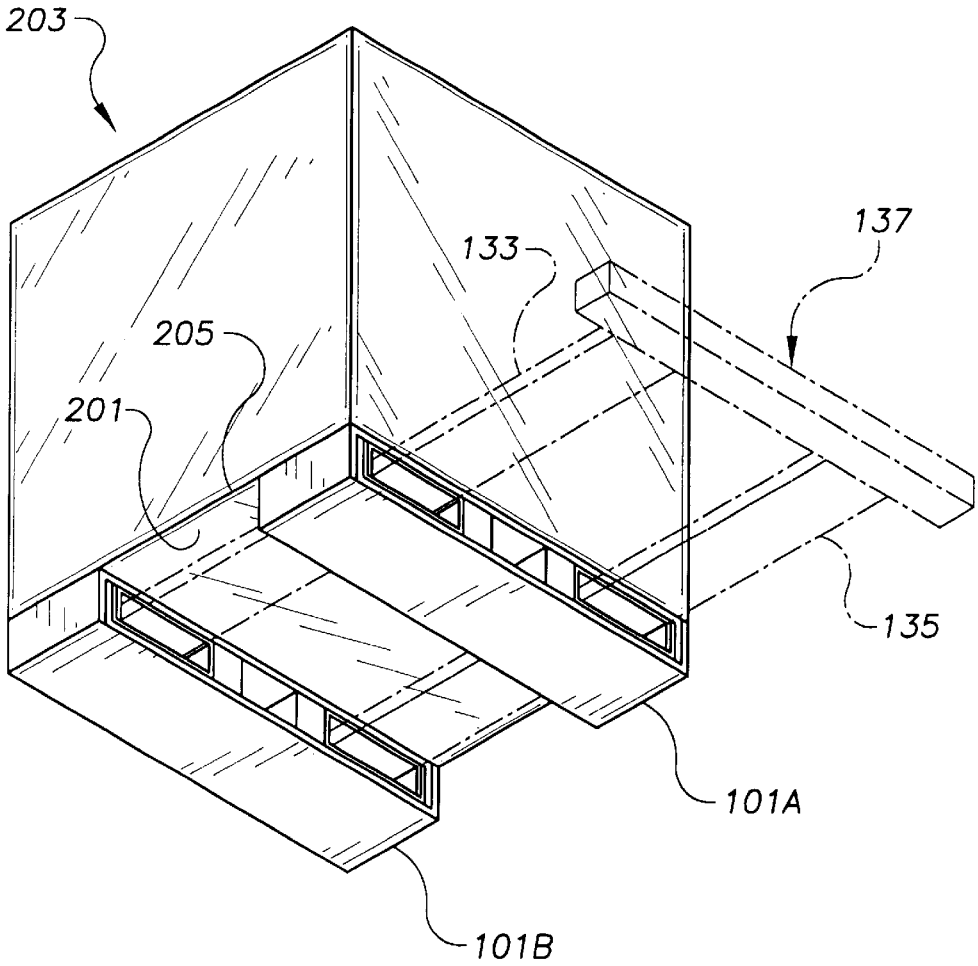
FIG. 2 is a perspective drawing of an embodiment of a container system comprising a container and two pallet feet bonded to the bottom of the container, the pallet feet having two box stringers for insertion of the tines of a forklift unit shown in broken lines.

FIG. 2 is a perspective drawing of two pallet feet 101A and 101B bonded to the bottom panel 201 of a corrugated container 203. Bonding may be made by hot-melt or cold-melt adhesives placed between top panel 109A of FIG. 1 and bottom panel 201 of container 203. Alternatively, contact adhesives, banding or mechanical fasteners may be used. Alignment of lift opening centerlines of pallet feet 101A and 101B allow penetration of fork tines 133 and 135 of fork lift apparatus 137 into the respective lift openings of both pallet feet to allow two way (front and back) lift of container 203. Depending on the length of edge 205, the spacing of two or more pallet feet allow lifting of container 203 by forklift apparatus 137 four ways (front/back, side/side).

Figure 3:
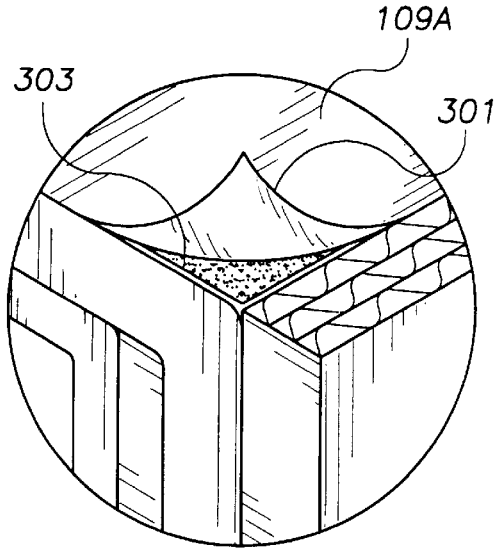
FIG. 3 is a perspective detail drawing of an adhesive disposed on the top panel of the pallet foot of FIG. 1 and a peel strip covering the adhesive.

FIG. 3 is a detail drawing of an alternative embodiment of pallet foot 101 employing a peel strip 301, partially peeled back to show contact adhesive 303 applied to top panel 109A.

Figure 4:
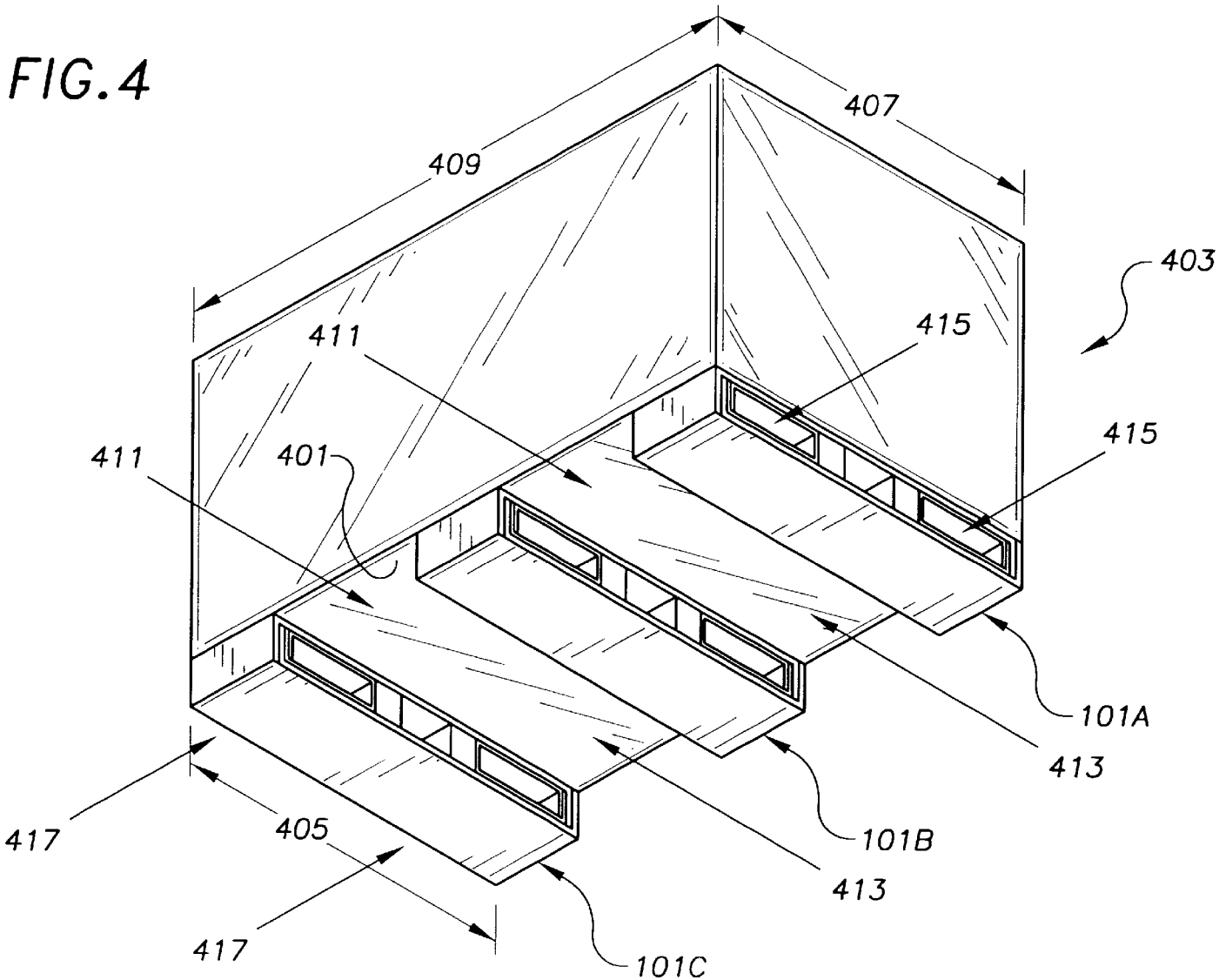
FIG. 4 is a perspective drawing of an alternative embodiment of the container system comprising a container and three pallet feet bonded to the bottom panel of the container, the pallet feet disposed so that the tines of a forklift assembly are insertable from any of the four sides of the container.

FIG. 4 is a perspective drawing of an alternative embodiment utilizing three pallet feet 101A, 101B and 101C bonded to bottom 401 of container 403. In the preferred embodiments; the length 405 of the pallet feet is a substantial width 407 of container 403. Pallet feet 101A, 101B and 101C are spaced along the length 409 of container 403 to allow insertion of lift fork tines at locations 411 and 413. The spacing of the through openings such as the box stringers of the pallet feet allows insertion of lift forks from directions 415 and 417. Axes of the respective through openings of the pallet feet are aligned co-axially, allowing penetration of the tines through respective openings of at least two and, preferably, all of the pallet feet necessary for lifting of the container. In this way the container/pallet foot assembly may be lifted from any of four directions. In still other embodiments, container 403 may be a container portion such as a container tray or comprise only a panel such as bottom panel 401.

Figure 5:
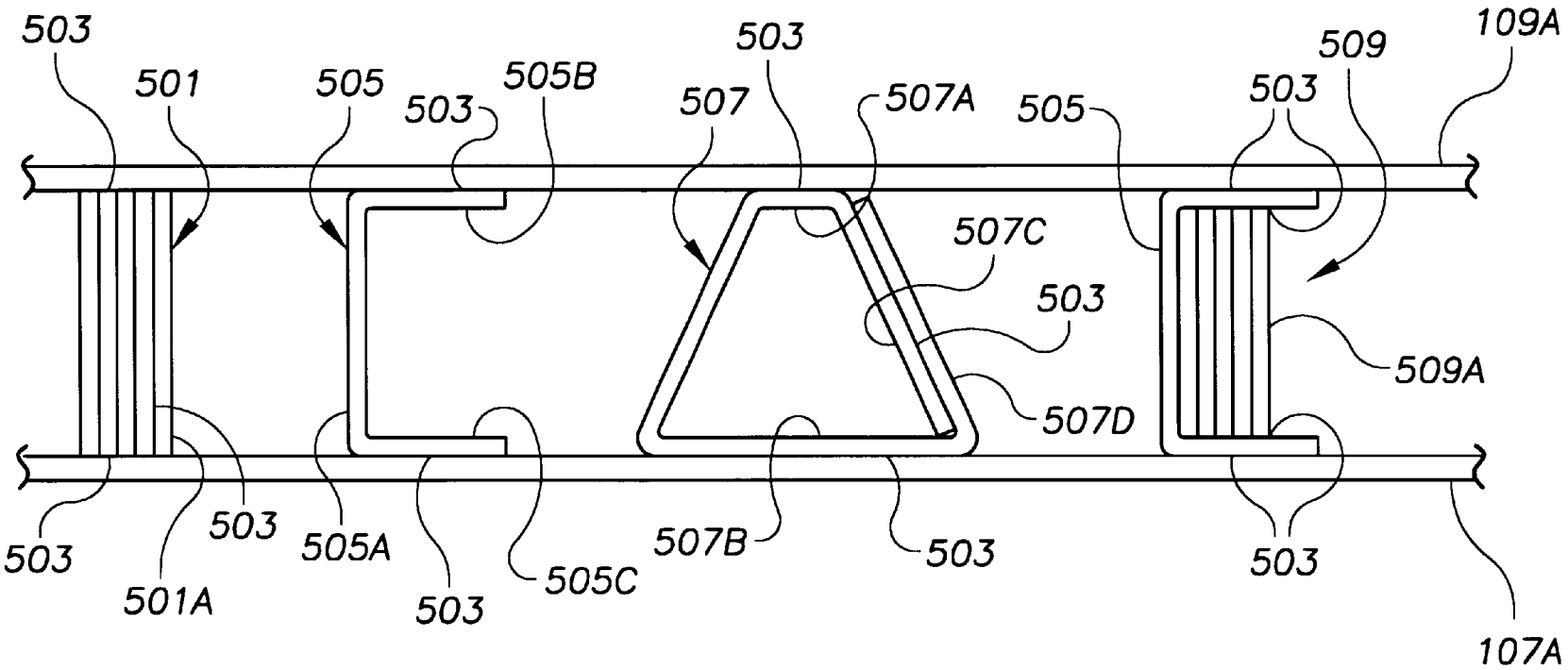
FIG. 5 is an end drawing showing the structure of several auxiliary stringers of the pallet foot including built-up or bonded rectangular stringers, "C" cross-section stringers, and trapezoidal cross-section stringers.

FIG. 5 is a side view of a pallet foot showing examples of other stringer shapes which maybe used with the invention. Stringer 501 is made up of laminated panels 501A bonded together by bonding agent 503. In the preferred embodiments, panels 501A are made of corrugated material such as single-wall corrugated material. The ridges and valleys of the corrugated material may be placed vertically to increase stacking strength of the pallet foot. Adhesive 503 bonds the ends of stringer 501 to pallet top panel 109A and pallet foot bottom panel 107A.

Stringer 505 is comprises a C-shaped cross-section and consists of vertical web 505A, top leg 505B and bottom leg 505C. Adhesive 503 bonds respective top and bottom legs to top panel 109A and bottom panel 107A.

Stringer 507 has a trapezoid shape such as an isosceles trapezoid and comprises top portion 507A and bottom portion 507B. In the preferred embodiments, portions 507A and 507B are parallel and bonded to top panel 109A and bottom panel 107A respectively by adhesive 503. Adhesive 503 bonds overlapping portions 507C and 507D.

Stringer 509 is a composite stringer comprising a C-shaped portion 505 and a laminated portion 509A. Laminated portion 509A is similar to stringer 501 with panel portions shorter by the combined thickness of the top and bottom legs of the stringer. Adhesive 503 bonds the top and bottom legs to the respective top panel 109A and bottom panel 107A.

Figure 6:
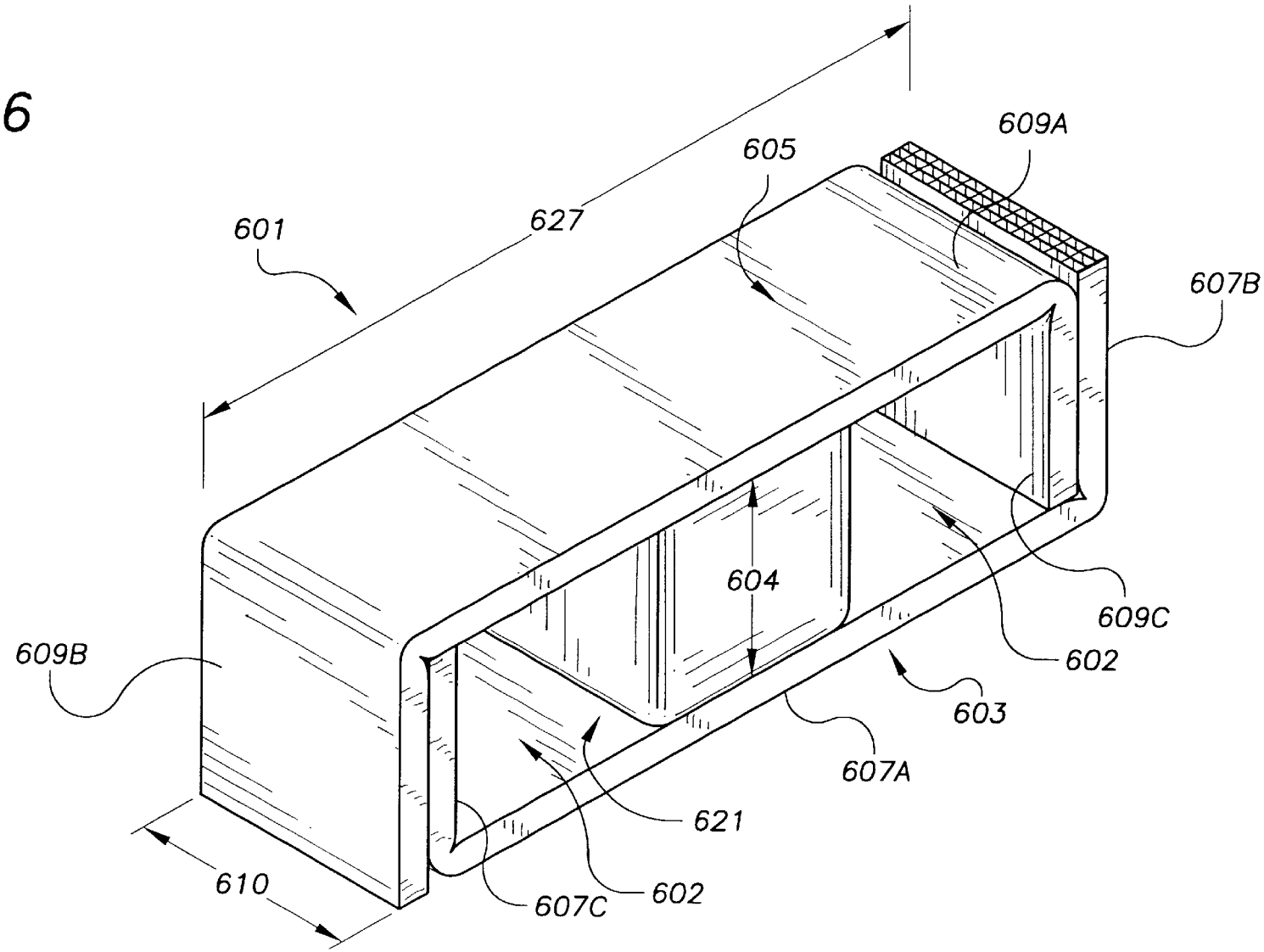
FIG. 6 is a perspective drawing of an alternative embodiment of the pallet foot having a bottom portion with a folded inner side and a folded outer side, an identical inverted top portion with a folded inner side and a folded outer side, the top and bottom portions bonded at the respective inner and outer sides and a single stringer made from a wrapped single-wall corrugated material, the stringer bonded to the top and bottom panels of the pallet foot.

FIG. 6 is a perspective drawing of preferred embodiment 601 of the pallet foot made from assembling and bonding inverted U-shaped top portion 605 to U-shaped bottom portion 603 between respective inner and outer side panels. Top portion 605 and bottom portion 603 are bonded together at the interface between inner side panels 607C and 609C and outer side panels 607B and 609B by an adhesive (not shown). In the preferred embodiments, top portion 605 and bottom portion 603 are made from scored and folded triple wall corrugated containerboard.

The length 627 of pallet foot 601 is normally the approximate width of the container to which the pallet foot is attached. The width 610 of the pallet foot is less than one half of the container length so that two or more pallet feet are accommodated on the bottom panel of the container. An adhesive (not shown) bonds stringer 621 at the under side of top panel 609A and the upper side of bottom panel 607A in opening 602. The depth 604 of stringer 621 is the same as the depth of opening 602. In the preferred embodiments, stringer 621 is positioned in the center of opening 602. In other embodiments, additional stringers 621 are spaced in opening 602. In the preferred embodiments, the stringer or stringers are positioned in opening 602 such that resulting through openings align with tines of standard lift equipment as shown in FIG. 1

Figure 6A:
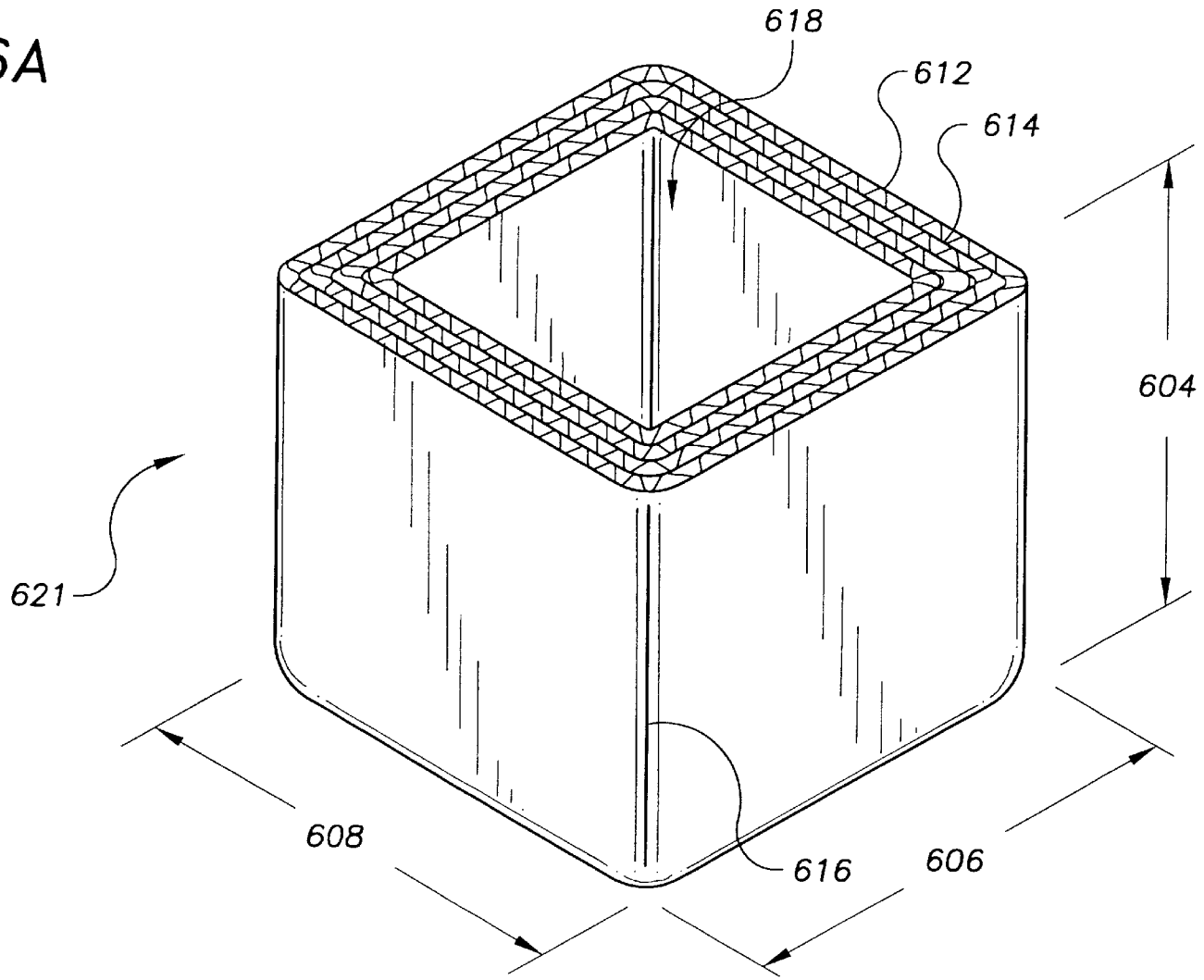
FIG. 6A is a perspective detail of the stringer of FIG. 6.

FIG. 6A is a perspective detail drawing of stringer 621. In the preferred embodiments, stringer 621 is made of spirally wound, single-wall corrugated containerboard. In the preferred embodiments, stringer 621 is rectangular when viewed from above. The length 606 of stringer 621 is typically 6"–8" to allow clearance for insertion of standard forklift and pallet lift tines into openings 602 of pallet fool 601. In the preferred embodiments, the width 608 of stringer 621 is the width 610 of pallet foot 601. Stringer depth 604 is typically 3.5"–4" to accommodate standard lift device tines. In other embodiments, stringer 621 is made of single-face corrugated material.

In the preferred embodiments, the ridges 612 and valleys 614 of the corrugated material 616 of stringer 621 run vertically (in the direction of depth 604) to improve stacking strength. Adjacent wrapped layers of corrugated material 616 may be bonded with an adhesive to increase the strength of stringer 621. In the preferred embodiments, stringer 621 comprises an open core portion 618.

During manufacture, an adhesive maybe applied to the top and bottom portions of stringer 621 and bonded to the respective top portion 605 or bottom portion 603, before bonding portions 605 and 603 together at the respective inner and outer side panels. An adhesive strip, similar to that shown in FIG. 3 may be applied to top panel 609A for attaching to a container bottom portion. In still other embodiments, pallet feet are attached to partial containers or container bottom portions such as corrugated trays, design style trays or multi-wall corrugated sheets.

In still other embodiments, contact adhesive and peel strips such as those shown in FIG. 3 may be applied to the inner face of the respective outer side panels 607B and 609B or the outer faces of respective inner side panels 607C and 609C. Likewise, additional contact adhesive and peel strips may be applied to the inside surface of respective top and bottom panels 609A and 607A at the desired location of stringers 621, or alternatively at top and bottom surfaces of stringer 621. In this manner, top and bottom portions and stringers may be assembled after removal of peel strips without separate bonding or fastening equipment.

Accordingly the reader will see that the pallet foot provides a low-cost recyclable pallet for supporting and shipping containers. The device provides the following additional advantages:

Top and bottom portions are identical and interchangeable, reducing tooling and inventory costs;

Pallet feet may be spaced to allow four-way insertion of lift equipment such as lift forks;

Loading characteristics of the pallet foot are identical for the top and bottom of the pallet foot;

Pallet feet allow greater flexibility for different size containers as compared to conventional pallets;

Adhesive strips allow quick attachment to the container;

The design allows selection of medium and liner weight to match desired stacking requirements, and The design permits fall assembly of a knock-down container without special tools or equipment.

Although the description above contains many specifications, these should not be construed as limiting the scope of the invention but as merely providing illustrations of some of the presently preferred embodiments of this invention. Thus the scope of the invention should be determined by the appended claims and their legal equivalents, rather than by the examples given.

I Claim:

1. A pallet foot for supporting a container, the pallet foot comprising:

a generally U-shaped bottom portion comprising a bottom panel, a first outside panel comprising a first inside face and a first inside panel comprising a first outside face, the bottom portion made of a corrugated material;

an inverted U-shaped top portion comprising a top panel, a second outside panel comprising a second inside face and a second inside panel comprising a second outside face, the top portion made of a corrugated material;

the first inside face of the first outside panel of the bottom portion attached to the second outside face of the second inside panel of the top portion, and the second inside face of the second outside panel of the top portion attached to the first outside face of the first inside panel of the bottom portion, the top portion and the bottom portion defining a rectangular opening extending through the pallet foot;

at least one reinforcing stringer in the rectangular opening spaced between the first inside panel and the second inside panel, said at least one reinforcing stringer attached to an inside surface of the pallet foot; and an attachment means on the pallet foot for attaching said pallet foot to a bottom portion of said container;

the corrugated material comprising ridges running in a length direction of the pallet foot perpendicular to a fold line defined by an intersection of the bottom panel and the first outside panel.

2. The pallet foot of claim 1 wherein said at least one stringer comprises a first box stringer of a width sufficient for insertion of one of a pair of spaced lift fork tines.

3. The pallet foot of claim 1 wherein said at least one stringer comprises a first box stringer of a width sufficient for insertion of one of a pair of spaced lift fork tines and a second box stringer of a width sufficient for insertion of a second of said pair of lift fork tines, said first box stringer and said second box stringer spaced in the rectangular opening to accept said pair of spaced lift fork tines.

4. The pallet foot of claim 1 wherein the top portion and the bottom portion are of identical dimensions.

5. The pallet foot of claim 1 comprising a width dimension which is less than one-half of a length dimension of a container bottom whereby at least two pallet feet are attachable to the container bottom without overlap of said at least two pallet feet from the container bottom, the width dimension of the pallet foot being along a fold line defined by an intersection of the bottom panel and the first outside panel.

6. The pallet foot of claim 1 wherein the top panel comprises an adhesive on an outside face of the top panel for bonding the pallet foot to the container.

7. The pallet foot of claim 6 comprising a peel strip covering the adhesive.

8. A recyclable corrugated container for use with a lift fork, the container comprising:

a container bottom comprising a bottom face;

at least two pallet feet made of a corrugated material, each of said at least two pallet feet comprising a generally U-shaped bottom portion and an inverted U-shaped top portion overlapped to define at least a pair of spaced lift fork tine openings of sufficient width to accept a lift fork tine, the openings being through openings having a through axis;

said at least two pallet feet attached to the bottom face of the container bottom wherein the through axis of each of said at least a pair of spaced lift fork tine openings of said at least two pallet feet are coaxial.

9. The recyclable container of claim 8 wherein said at least two pallet feet comprise a predetermined spacing on the container bottom allowing tines of said lift fork to be inserted between each of said at least two pallet feet whereby the tines are insertable from four sides of the corrugated container.

10. The recyclable container of claim 8 wherein the top portion and the bottom portion comprise the same dimensions.

11. The recyclable container of claim 8 wherein each of said at least a pair of spaced lift fork openings are formed by a box stringer made of corrugating material.

12. The recyclable container of claim 11 comprising an auxiliary stringer spaced between said at least a pair of spaced lift fork openings.

13. The recyclable container of claim 11 comprising an auxiliary stringer attached to the box stringer.

14. A recyclable support apparatus for articles comprising:

a bottom panel of corrugated material, the bottom panel comprising a bottom face; and at least two pallet feet made of a corrugated material, each of said at least two pallet feet comprising a generally U-shaped bottom portion and an inverted U-shaped top portion overlapped to define at least a pair of spaced lift fork tine openings of sufficient width to accept a lift fork tine, the openings being through openings having a through axis;

said at least two pallet feet attached to the bottom face of the bottom panel wherein the through axis of each of said at least a pair of spaced lift fork tine openings of said at least two pallet feet are coaxial.

15. The recyclable support apparatus of claim 14 wherein the top portion and the bottom portion comprise the same dimensions.

* * * * *